United States Patent [19]

Brattan et al.

[11] Patent Number: 4,822,461

[45] Date of Patent: Apr. 18, 1989

[54] ELECTROLYTIC CELL

[75] Inventors: Keith Brattan, Gt Boughton; Stephen J. Hornby, Widnes; Govinder S. Sehmi, Knutsford, all of England

[73] Assignee: Imperial Chemical Industries PLC, London, England

[21] Appl. No.: 62,689

[22] Filed: Jun. 16, 1987

[30] Foreign Application Priority Data

Jun. 17, 1986 [GB] United Kingdom ..... 8614706

[51] Int. Cl.[4] ..... C25B 1/14

[52] U.S. Cl. ..... 204/98; 204/128; 204/269; 204/255

[58] Field of Search ..... 204/255, 245, 246, 98, 204/128, 269

[56] References Cited

U.S. PATENT DOCUMENTS

| | | | |
|---|---|---|---|
| 3,855,104 | 12/1974 | Messner | 204/256 |
| 3,856,651 | 12/1974 | Raetzsch et al. | 204/255 |
| 3,990,961 | 11/1976 | Raetzsch et al. | 204/255 |
| 4,124,478 | 11/1978 | Tsien et al. | 204/255 |
| 4,197,178 | 4/1980 | Pellegri et al. | 204/255 |
| 4,214,969 | 7/1980 | Lawrance | 204/255 |
| 4,323,444 | 4/1982 | Kawamura et al. | 204/269 |
| 4,425,215 | 1/1984 | Henes | 204/258 |
| 4,557,816 | 12/1985 | Yoshida et al. | 204/255 |
| 4,645,953 | 3/1987 | Wardle et al. | 204/255 |
| 4,648,953 | 3/1987 | Wardle et al. | 204/237 |

*Primary Examiner*—R. L. Andrews

*Attorney, Agent, or Firm*—Cushman, Darby & Cushman

[57] ABSTRACT

An electrolytic cell which is preferably of the filter press type and which comprises at least one anode and at least one cathode, an inlet through which liquor may be charged to the electrolytic cell and an outlet through which liquor may be removed from the electrolytic cell, and means for recirculating liquor to the electrolytic cell, in which said recirculating means comprises a unit formed of a plurality of shaped sheets which are preferably planar and together form at least one channel inside of said unit, said channel connecting the inlet and outlet of the electrolytic cell.

25 Claims, 1 Drawing Sheet

ELECTROLYTIC CELL

BACKGROUND OF THE INVENTION

1. Field of the Invention

This invention relates to an electrolytic cell and in particular to an electrolytic cell which is provided with liquor recirculating means.

Electrolytes, for example, aqueous solutions of alkali metal chlorides, particularly sodium chloride, are electrolysed on a vast scale throughout the world in order to produce products such as chlorine and aqueous alkali metal hydroxide solution. The electrolysis may be effected in an electrolytic cell comprising a plurality of anodes and cathodes with each anode being separated from the adjacent cathode by a separator which divides the electrolytic cell into a plurality of anode and cathode compartments.

2. Description of the Prior Art

The electrolytic cell may be of the diaphragm or membrane type. In the diaphragm type cell the separators positioned between adjacent anodes and cathodes are microporous and in use aqueous electrolyte passes through the diaphragms from the anode compartments to the cathode compartments of the cell. In the membrane type cell the separators are essentially hydraulically impermeable and in use ionic species are transported across the membranes between the anode compartments and the cathode compartments of the cell.

For example, where aqueous alkali metal chloride solution is electrolysed in an electrolytic cell of the diaphragm type the solution is charged to the anode compartments of the cell, chlorine which is produced in the electrolysis is removed from the anode compartments of the cell, the alkali metal chloride solution passes through the diaphragms and hydrogen and alkali metal hydroxide produced by electrolysis are removed from the cathode compartments, the alkali metal hydroxide being removed in the form of an aqueous solution of alkali metal chloride and alkali metal hydroxide. Where an aqueous alkali metal chloride solution is electrolysed in an electrolytic cell of the membrane type the solution is charged to the anode compartments of the cell and chlorine produced in the electrolysis and depleted alkali metal chloride solution are removed from the anode compartments, alkali metal ions are transported across the membranes to the cathode compartments of the cell to which water or dilute alkali metal hydroxide solution may be charged, and hydrogen and alkali metal hydroxide solution produced by the reaction of alkali metal ions with water are removed from the cathode compartments of the cell.

The electrolysis may be effected in an electrolytic cell of the filter press type which may comprise a large number of alternating anodes and cathodes, for example, fifty anodes alternating with fifty cathodes, although the cell may comprises even more anodes and cathodes, for example up to one hundred and fifty alternating anodes and cathodes.

The electrolytic cell may be provided with an inlet header through which electrolyte, for example aqueous alkali metal chloride solution, may be charged to the anode compartments of the cell, and with an outlet header through which products of electrolysis may be removed therefrom. Also, the electrolytic cell may be provided with an outlet header through which products of electrolysis may be removed from the cathode compartments of the cell, and optionally, e.g. in the case of a membrane type cell, with an inlet header through which liquor, for example water or other fluid, may be charged thereto.

Electrolytic cells may be fitted with means for recirculating the liquors to the anode and/or cathode compartments of the cell. For example, in an electrolytic cell of the membrane type in which aqueous alkali metal chloride solution is electrolysed the solution is charged to the anode compartments of the cell through an inlet header and chlorine and depleted aqueous alkali metal chloride solution are removed therefrom through an outlet header. The electrolytic cell may be equipped with means for recirculating the depleted alkali metal chloride solution, or a part thereof, back to the anode compartments of the cell for re-use therein. Prior to effecting the recirculation the gaseous chlorine may be separated from the defleted alkali metal chloride solution, and the depleted solution may be mixed with alkali metal chloride or with fresh more concentrated aqueous alkali metal chloride solution prior to recirculation of the solution to the anode compartments. Recirculation of the aqueous alkali metal chloride solution enables the solution to be re-used and it ensures that a high conversion of alkali metal chloride may be effected without the conversion in a single pass through the anode compartments being so high that unacceptable concentration gradients result in the solution within the anode compartments of the cell, and between the solutions in different anode compartments of the cell, with consequent loss in current efficiency. Furthermore, as the solution removed from the cell is at high temperature the fresh solution may be at relatively low temperature. Indeed, it may be unnecessary to heat the fresh solution.

In such an electrolytic cell in which aqueous alkali metal chloride solution is electrolysed water is charged to the cathode compartments of the cell through an inlet header and hydrogen and dilute aqueous alkali metal hydroxide solution are removed therefrom through an outlet header. The electrolytic cell may be equipped with means for recirculating the alkali metal hydroxide solution, or a part thereof, back to the cathode compartments of the cell in order to increase the concentration of alkali metal hydroxide in the solution. Prior to effecting the recirculation the gaseous hydrogen may be separated from the alkali metal hydroxide solution, and the solution may be mixed with water prior to recirculation. If such recirculation was not effected it would be difficult to produce a solution of alkali metal hydroxide of high concentration, and if such a solution of high concentation was produced without recirculation there would be substantial concentration gradients in the solution within the cathode compartments of the cell, and between the solutions in different cathode compartments of the cell, with a consequent unacceptable loss in current efficiency.

The recirculation may be effected by means of suitable pipework positioned externally of the electrolytic cell. For example, the outlet header from the anode compartments of the cell may be connected to a branched outlet pipe and part of the depleted electrolyte removed from the anode compartments of the electrolytic cell may be passed through the branched pipe to an inlet pipe, which is in turn connected to the inlet header of the anode compartments of the cell, and through which fresh electrolyte may also be charged to the anode compartments of the cell. Part of the electrolyte removed from the anode compartments of the electrolytic cell may be removed from the cell through the branched pipe. Similarly, the outlet header from the cathode compartments of the cell may be connected to a branched outlet pipe and part of the liquor removed from the cathode compartments of the electrolytic cell may be passed through the branched pipe to an inlet pipe, which is in turn connected to the inlet header of the cathode compartments of the electrolytic cell, and through which liquor, such as water, may also be charged to the cathode compartments of the cell. Part of the liquor removed from the cathode compartments of the electrolytic cell may be removed from the cell through the branched pipe.

An electrolytic cell having pipework positioned externally of the cell and through which liquors may be recirculated is described in U.S. Pat. No. 3,856,651. The recirculation system relies for its effectiveness on the gas-lift effect, and in the patent there is described a bipolar cell having a tank positioned on top of the cell to which chlorine-containing aqueous sodium chloride solution is passed from the anode compartments of the cell. Chlorine is separated from the solution in the tank, and the solution is removed from the tank and mixed with fresh, more concentrated sodium chloride solution and returned to the anode compartments of the cell via an externally positioned pipe.

The recirculation may also be effected within the anode compartments of an electrolytic cell, or within the cathode compartments of an electrolytic cell, by means of downcomers positioned in the compartments of the cell, for example, by means of a downcomer positioned between a pair of electrode plates in an electrode compartment of a cell. Such recirculation also relies for its effectiveness on the gas-lift effect.

An electrolytic cell in which there is internal liquor recirculation is described in U.S. Pat. No. 4,557,816. In the patent there is described a duct which facilitates downward flow of electrolyte and which is positioned in a space to the rear of an electrode, the duct comprising a horizontal portion having a lower opening near the inlet for fresh electrolyte and a vertical portion in communication with the horizontal portion and having an upper opening near the outlet for the depleted electrolyte.

SUMMARY OF THE INVENTION

The present invention relates to an electrolytic cell which comprises such liquor recirculating means which is readily constructed and which is readily assembled, and which is particularly suitable for use with an electrolytic cell of the filter press type and which does not rely on the gas lift effect.

According to the present invention there is provided an electrolytic cell which comprises at least one anode and at least one cathode, an inlet through which liquor may be charged to the electrolytic cell and an outlet through which liquor may be removed from the electrolytic cell, and means for recirculating liquor to the electrolytic cell, in which said recirculating means comprises a unit formed of a plurality of shaped sheets which together form at least one channel inside of said unit, said channel connecting the inlet and outlet of the electrolytic cell.

The electrolytic cell may comprise at least one anode and at least one cathode and a separator positioned between each anode and adjacent cathode thereby dividing the cell into separate anode and cathode compartments, or into a plurality of such compartments. The separator may be a hydraulically impermeable ion-exchange membrane or a hydraulically permeable diaphragm.

The electrolytic cell may be a monopolar cell or a bipolar cell. In a monopolar cell a separator may be positioned between each anode and adjacent cathode. The electrolytic cell may be a bipolar cell comprising a plurality of electrodes having an anode face and a cathode face. In a bipolar cell a separator may be positioned between an anode face of an electrode and a cathode face of an adjacent electrode.

The electrolytic cell may comprise an inlet header through which liquor may be charged to the anode compartment(s) of the electrolytic cell, and an outlet header through which liquor may be removed from the anode compartment(s) of the electrolytic cell, in which the recirculating means comprises a unit formed of a plurality of shaped sheets which together form at least one channel inside of the unit, the channel connecting the inlet and outlet headers of the anode compartments of the electrolytic cell. Alternatively, or in addition, the electrolytic cell may comprise an inlet header through which liquor may be charged to the cathode compartment(s) of the electrolytic cell, and an outlet header through which liquor may be removed from the cathode compartment(s) of the electrolytic cell, in which the recirculating means comprises a unit formed of a plurality of shaped sheets which together form at least one channel inside of the unit, the channel connecting the inlet and outlet headers of the cathode compartments of the electrolytic cell. The unit may be formed of a plurality of shaped sheets which together form at least two channels inside of the unit one of which connects the inlet and outlet headers of the anode compartments of the electrolytic cell and the another of which channels connects the inlet and outlet headers of the cathode compartments of the electrolytic cell.

In the electrolytic cell of the invention the unit formed of a plurality of shaped sheets and which comprises at least one channel for recirculating liquors is particularly suitable for use with an electrolytic cell of the filter press type, although it is not limited to use with an electrolytic cell of this type.

A preferred form of electrolytic cell of the filter press type comprises a plurality of substantially planar anodes and cathodes and a plurality of gaskets of an electrically non-conducting material. In the electrolytic cell the gaskets may be positioned between adjacent anodes and cathodes thereby providing the required electrical insultation between the anodes and cathodes, or the anodes and cathodes may be positioned within frame-like gaskets. The inlet headers and outlet headers of the electrolytic cell may take any form but they may be formed by apertures in the gaskets, and in the anodes and cathodes when the gaskets are positioned between the anodes and cathodes, these apertures in the electrolytic cell together forming the headers. The gaskets, or the anodes and cathodes, may have means, for example slots, through which liquors may be charged to the anode and cathode compartments from the headers and through which liquors may be removed from the anode and cathode compartments to the headers.

The unit in the electrolytic cell of the invention is particularly suitable for attachment to an end of such a filter press cell comprising a plurality of substantially planar anodes, cathodes and gaskets.

The unit in the electrolytic cell of the present invention comprises a plurality of shaped sheets which together form at least one channel inside the unit, the channel connecting the inlet and outlet of the electrolytic cell, for example, the inlet and outlet headers of the anode compartments of the cell or the inlet and outlet headers of the cathode compartments of the electrolytic cell, and providing a channel or channels for recirculation of liquors.

The sheets which make up the unit in the electrolytic cell of the present invention may be so shaped as to provide an inlet channel through which fresh liquor may be charged to the unit and thence to the electrolytic cell. The unit may comprise an inlet channel through which liquor may be charged to the anode compartments of the electrolytic cell and/or a channel through which liquior may be charged to the cathode compartments of the electrolytic cell.

In operation of the electrolytic cell liquor is removed from the cell and recirculated and optionally fresh liquor is also charged to the cell. Where fresh liquor is charged to the cell not all the liquor removed from the cell should be recirculated through the unit back to the cell and the sheets which make up the unit may be so shaped as to provide an outlet channel through which a portion of the liquor removed from the cell may be removed from the unit. Gaseous products of electrolysis may also be removed through this outlet channel. The unit may be provided with an outlet channel through which a portion of the liquors removed from the anode compartments of the cell may be removed from the unit and/or an outlet channel through which a portion of the liquors removed from the cathode compartments of the cell may be removed from the unit. In the unit the inlet channel(s) may be operatively connected to the channel(s) through which liquor recirculation is effected.

The sheets in the unit will in general be substantially planar, although they are not necessarily planar, and the sheets will in general be of the same or similar size, that is their external dimensions of length and breadth will be the same or similar. The sheets may each have the same or similar thickness, or they may be of different thicknesses.

The sheets are so shaped that when positioned together they form a unit having a channel or channels therein through which liquor may be recirculated and optionally through which liquor may be charged to or removed from the unit. The sheets may be shaped in a variety of different ways in order to provide the channels, for example, one sheet may comprise a groove in a face of the sheet which, when placed adjacent to a plane sheet, forms a channel in the plane of the sheets. Alternatively, two sheets may each comprise a groove in a face of each sheet which when placed adjacent to each other in the unit form a channel in the plane of the sheets. One sheet may comprise a slot which forms a channel in the plane of the sheets when plane sheets are positioned on either side of the slotted sheet.

In an alternative embodiment, the sheets may comprise an aperture or apertures therein which cooperate with each other to form a channel or channels in the unit in a direction generally transverse to the plane of the sheets.

In a preferred embodiment of the unit the sheets comprise apertures therein which in the unit cooperate to form a channel or channels in a first direction in the unit in a direction transverse to the plane of the sheets, and at least some of the sheets comprise slots, grooves or the like which in the unit form a channel or channels in a second direction in the plane of the sheets and which is generally transverse to the first direction, the channel or channels in the first direction being operatively connected to the channel or channels in the second direction. The channel or channels in the first direction may lead to or from the inlet or outlet headers of the electrolytic cell when the unit is operatively attached to the electrolytic cell, and in a preferred embodiment the sheets have four apertures therein which lead to the inlet headers to the anode and cathode compartments of the electrolytic cell and which lead from the outlet headers from the anode and cathode compartments of the electrolytic cell. The channel or channels in a second direction are operatively connected to the channel or channels in a first direction. For example, a slot or groove in a sheet may be connected to two apertures in the same sheet. In this way it is possible, by an appropriate positioning of apertures, slots, grooves and the like in the sheets of the unit to have in the unit a channel leading to the inlet header of the anode compartments of the electrolytic cell and a channel leading from the outlet header of the anode compartments of the electrolytic cell, and a further channel connecting the channels leading to and from the inlet and outlet headers and through which liquor may be recirculated to the anode compartments of the electrolytic cell. Similarly, it is possible, by an appropriate positioning of apertures, slots, grooves and the like in the sheets of the unit to have in the unit a channel leading to the inlet header of the cathode compartments of the electrolytic cell and a channel leading from the outlet header of the cathode compartments of the electrolytic cell, and a further channel connecting the channels leading to and from the inlet and outlet headers and through which liquor may be recirculated to the cathode compartments of the electrolytic cell.

In a preferred embodiment of the invention the unit comprises at least one ejector which promotes recirculation of liquors to the electrolytic cell through the unit. Fresh liquor may be charged to the unit through the ejector. The ejector is a simple device which is generally of tubular shape having an inlet end and a throat at or near the outlet end of the device, the throat at or near the outlet end being of smaller cross-sectional area than the inlet end. Thus, in operation liquor charged to the inlet end of the ejector is caused to issue from the outlet end of the ejector at an increased velocity, the issuing liquor entraining the liquor in the unit which has been removed from the electrolytic cell and causing this liquor, or a part thereof, to be recirculated through the unit back to the electrolytic cell.

A channel in the unit, e.g. an inlet channel, may be so shaped as to comprise an ejector, or an ejector may be positioned in a channel of the unit, e.g. in an inlet channel.

The unit may comprise two ejectors so positioned as to promote recirculation of liquors to the anode compartments and to the cathode compartments of the electrolytic cell respectively.

The sheets in the unit are preferably made of, or at least have faces of, an electrically non-conducting material, particularly if the unit comprises channels which in use carry liquors from both the anode and cathode compartments of the electrolytic cell. In this latter case the liquors must be electrically insulated one from the other in the unit. The sheets are suitably made of an electrically non-conducting plastics material which is preferably flexible in order to aid sealing to an adjacent sheet and which is resistant to corrosion by the liquors in the anode and cathode compartments of the electrolytic cell, for example, which is resistant to corrosion by sodium chloride solution, especially such a solution containing chlorine, by wet chlorine, and by aqueous sodium hydroxide solution.

The plastics material may be a polyolefin, for example, polyethylene, polypropylene, or an elastomeric polyolefin, e.g. an ethylene-propylene copolymer elastomer or an ethylene-propylene-diene copolymer elastomer. Polyolefins have the advantage that polyolefin sheets are readily bonded to each other by a number of different techniques, for example, heat welding, ultrasonic welding, or by the use of adhesives in order to form the unit. However, polyolefins may not be sufficiently resistant to corrosion by the liquors in the electrolytic cell and it may be desirable, in order to increase the corrosion resistance, to provide a coating of a corrosion resistant material, for example a fluoropolymer, e.g. polytetrafluoroethylene, at least on those surfaces of the polyolefin sheets which in the unit contact these liquors.

The plastics material may be a halogenated polyolefin, for example, polyvinyl chloride. Preferred halogenated polyolefins are fluorine-containing polyolefins, for example polyvinylidene fluoride, polyhexafluoropropylene, fluorinated ethylene-propylene copolymer, and particularly polytetrafluoroethylene, on account of the corrosion resistance of such fluorine-containing polyolefins. Such fluorine-containing polyolefins are not readily bonded by means of adhesives. They may be bonded by the use of heat welding or ultrasonic welding.

A preferred plastics material is an acrylonitrile-butadiene-styrene polymer. Such a plastics material is well-known in the art and is readily available commercially. We have found that it is surprisingly resistant to corrosion by the liquors such as sodium chloride and sodium hydroxide solution and that it possesses the additional advantages that it is readily fabricated into suitably shaped sheets by a number of different plastics processing techniques, for example, injection moulding, compression moulding and extrusion, and that sheets of such a plastics material are readily bonded to each other by a number of different techniques.

The sheets in the unit may be shaped, that is the sheets may be provided with apertures, slots, grooves or the like as required by machining of substantially planar sheets, or, where the sheet is made of a suitable plastics material, by use of plastics processing techniques, for example, compression moulding, injection moulding, or extrusion.

The sheets in the unit may be held together by means of tie rods, e.g. in the manner in which the components parts of a filter press cell may be held together by tie rods. Indeed, the same tie rods may be used to hold together the sheets of the unit and the component parts of the electrolytic cell, with the unit being positioned at one end of the electrolytic cell. Such units may be positioned at both ends of the electrolytic cell. Alternatively, the sheets of the unit, particularly when made of a plastics material, may be bonded together by use of a suitable adhesive or by use of heat welding or ultrasonic welding. Where the electrolytic cell comprises component parts, e.g. frame members, made of plastics material the unit may be similarly bonded to the electrolytic cell.

The electrolytic cell is preferably of the filter press type and a preferred form of electrolytic cell of this type comprises a plurality of anodes and cathodes and gaskets of an electrically non-conducting material. Where the electrodes are positioned within frame-like gaskets the gaskets may be bonded to each other in the manner described with reference to the sheets of the unit which is associated with the electrolytic cell.

In the electrolytic cell the separator may be a microporous hydraulically permeable diaphragm or a substantially hydraulically impermeable ionically permselective membrane, for example a cation-exchange membrane.

The separator may be positioned between adjacent anode and cathode frame-like gaskets. It may be sealed to one or other or to both of the frame-like gaskets, or it may merely be held in position by being trapped between the frame-like gaskets. Thus, the separator may have a surface area greater than that of the anode or cathode but not so great as to cover the entire face of a frame-like gasket. The separator may be positioned in a recess in the frame-like gasket and sealed thereto. In this embodiment of the electrolytic cell the frame-like gaskets of electrically non-conducting plastics material within which the anodes and cathodes are positioned may be sealed directly to each other with a separator trapped therebetween.

In an alternative embodiment, the separator may be sealed to and, for example, positioned within a frame-like gasket of an electrically non-conducting plastics material other than those to which the anodes and cathodes are fixed. This separator frame-like gasket may be positioned between frame-like gaskets to which anodes and frame-like gaskets to which cathodes are affixed and be bonded thereto. In this case the anode and cathode frame-like gaskets may be bonded indirectly to each other via the separator frame-like gasket.

The electrolytic cell may comprise frame-like gaskets of an electrically non-conducting plastics material other than those to which the anodes and cathodes are affixed or to which the separators are affixed. For example, the electrolytic cell may comprise such frame-like gaskets having a central opening therein to provide in the electrolytic cell a space for the anode and cathode compartments. Such a frame-like gasket may be positioned in the electrolytic cell between the separator, or frame-like gasket associated with the separator, and an adjacent anode gasket, and between the separator, or frame-like gasket associated with the separator, and an adjacent cathode frame-like gasket. Alternatively, space for the anode and cathode compartments may be provided by using anode and cathode frame-like gaskets, and/or separator framelike gaskets of a thickness such as to provide the required space. For example, the anode and cathode frame-like gaskets may have a central opening therein in which the anode and cathode respectively are positioned and the frame-like gaskets may have a thickness greater than that of the anode and cathode.

The frame-like gaskets of the electrolytic cell are made of an electrically non-conducting plastics material, which may be thermoplastic or thermoset, and may be of an elastomeric material, as described with reference to the sheets of the unit associated with the electrolytic cell.

The anodes and cathodes of the electrolytic cell must be electro-conducting and they should have an electrocatalytically active surface, which may be provided by a suitable coating. The anodes and/or cathodes may consist of a metallic substrate, which may have a foraminate structure, for example it may be a perforated plate or be in the form of a mesh, e.g. a woven or non-woven mesh, or an expanded metal. Alternatively, the anodes and/or cathodes may comprise a plurality of elongated members which are preferably parallel to each other and which are also preferably vertically disposed in the electrolytic cell.

The choice of anode and cathode substrate and of coating, if any, will depend on the nature of the electrolyte to be electrolysed. Where the electrolyte is an aqueous solution of an alkali metal chloride a suitable metal for the anode is selected from the film-forming metals, for example, titanium, tantalum, zirconium, niobium or hafnium.

A suitable metal for the cathode is steel or nickel.

The anode and/or cathode may comprise a core of another metal having an outer face of one of the above metals.

Suitable electrocatalytically active coatings which may be applied to the surfaces of the anodes and/or cathodes include, in the case of anodes, an oxide of a platinum group metal preferably in admixture with an oxide of a film-forming metal, particularly a mixture in the form of a solid solution, and, in the case of cathodes, a platinum group metal. Such coatings, and methods of application, are well-known in the art.

Where the electro-conducting electro-catalytically active portion of the anode and/or cathode comprises a metallic member the latter may be affixed to the frame member of electrically non-conducting plastics material by, for example, moulding the plastics material into the form of a frame member around the anode or cathode. For example, the anode or cathode may be positioned in a mould and the plastics material may be moulded by compression moulding, by injection moulding, or by extrusion, into the form of a frame member around the anode or cathode.

The anode and/or the cathode may itself comprise a substrate of a plastics material which material may be the same as or different from the plastics material of the frame member. As the substrate must be electro-conducting, and as plastics materials are generally electrically non-conducting, it follows that the plastic substrate must be modified so as to make it electro-conducting. Such modification may be achieved in a number of different ways. For example, the substrate of plastics material may be filled with a substantial proportion of carbon black or graphite or other electrically conducting particulate metal. It may comprise metallic fibre or non-metallic fibre having a coating of metal. The fibre may be randomly distributed throughout the substrate of plastics material. Alternatively, or in addition, the substrate of plastics material may have one or more foraminate metal members embedded therein, e.g. in the form of a mesh, which may be woven or unwoven or in the form of an expanded metal. The embedded metal member may act as a current distributor in the case where the anode or cathode is monopolar, in which case it may project from an edge of the plastics substrate and through the frame member in order to provide a means for electrical connection.

The substrate of plastics material may carry a metal layer on its face, for example a layer of a film-forming metal in the case of an anode, and a layer of nickel in the case of a cathode.

The substrate of plastics material may function as a bipolar electrode, in which case it conveniently may carry a layer of a film-forming metal on its anode face and a layer of nickel on its cathode face.

Where the anode and/or cathode is a metal-coated substrate of a plastics material it is particularly suitable to use as the substrate an acrylonitrilebutadiene-styrene polymer material as such a material is readily metal coated.

Where the separator is a hydraulically permeable diaphragm it may be made of a porous organic polymeric material. Preferred organic polymeric materials are fluorine-containing polymers on account of the generally stable nature of such materials in the corrosive environment encountered, for example, in chlor-alkali electrolytic cells. Suitable fluorine-containing polymeric materials include, for example, polychlorotrifluoroethylene, fluorinated ethylenepropylene copolymer, and polyhexafluoropropylene. A preferred fluorine-containing polymeric material is polytetrafluoroethylene on account of its great stability in corrosive chlor-alkali electrolytic cell environments.

Such hydraulically permeable diaphragm materials are known in the art.

Preferred separators for use as membranes which are capable of transferring ionic species between the anode and cathode compartments of an electrolytic cell are those which are cation perm-selective. Such ion exchange materials are known in the art and may be fluorine-containing polymeric materials containing anionic groups. The polymeric materials, particularly where the membrane is to be used in the corrosive environment of a chlor-alkali electrolytic cell, are preferably fluorocarbons containing the repeating groups $$[C_mF_{2m}]_M \text{ and } [CF_2-\underset{\underset{X}{|}}{CF}]_N$$

where m has a value of 2 to 10, and is preferably 2, the ratio of M to N is preferably such as to give an equivalent weight of the groups X in the range 600 to 2000, and X is chosen from $$[OCF_2-\overset{\overset{A}{|}}{\underset{\underset{Z}{|}}{CF}}]_p A \quad \text{or}$$

where p has a value of for example 1 to 3, Z is fluorine or a perfluoroalkyl group having from 1 to 10 carbon atoms, and A is a group chosen from the groups:

$-SO_3H$
$-CF_2SO_3H$
$-CCl_2SO_3H$
$-X^1SO_3H$
$-PO_3H_2$
$-PO_2H_2$
$-COOH$ and
$-X^1OH$ or derivatives of the said groups, where $X^1$ is an aryl group. Preferably A represents the group $SO_3H$ or $-COOH$. $SO_3H$ group-containing ion exchange membranes are sold under the tradename 'Nafion' by E I du Pont de Nemours and Co Inc and —COOH group-containing ion exchange membranes under the tradename 'Flemion' by the Asahi Glass Co Ltd.

The electrolytic cell will be provided with headers from which, in the case of a cell for the electrolysis of aqueous sodium chloride solution, the solution may be charged to the anode compartments and with headers from which chlorine and optionally depleted sodium chloride solution may be removed from the anode compartments, and the cathode compartments of the cell will be provided with headers from which hydrogen and cell liquor containing sodium hydroxide may be removed from the cathode compartments, and optionally, and if necessary, with headers from which water or dilute sodium hydroxide solution may be charged to the cathode compartments.

A preferred type of electrolytic cell comprises frame members of plastics material having a plurality of apertures therein which in the cell define separate compartments lengthwise of the cell which serve as the headers and through which the electrolyte may be fed to the cell, e.g. to the anode compartments of the cell, and the products of electrolysis may be removed from the cell, e.g. from the anode and cathode compartments of the cell. The headers lengthwise of the cell may communicate with the anode compartments and cathode compartments of the cell via channels, e.g. slots, in the frame-like gaskets.

Where the electrolytic cell comprises hydraulically permeable diaphragms there may be two or three apertures which define two or three compartments lengthwise of the cell which serve as headers from which electrolyte may be fed to the anode compartments of the cell and through which the products of electrolysis may be removed from anode and cathode compartments of the cell.

Where the electrolytic cell comprises cation permselective membranes there may be four apertures which define four compartments lengthwise of the cell which serve as headers from which electrolyte and water or other fluid may be fed respectively to the anode and cathode compartments of the cell and through which the products of electrolysis may be removed from the anode and cathode compartments of the cell.

The electrolytic cell of the invention which is provided with recirculating means is particularly suitable for use in the electrolysis of aqueous alkali metal chloride solution, e.g. aqueous sodium chloride solution to produce chlorine, and hydrogen and aqueous alkali metal hydroxide solution. However, the cell is not limited to use in such electrolysis.

BRIEF DESCRIPTION OF THE DRAWING

An embodiment of the present invention will now be described with the aid of the accompanying figures in which.

DETAILED DESCRIPTION OF THE PRESENTLY PREFERRED EXEMPLARY EMBODIMENT

The specific embodiment will be described by reference to the electrolysis of aqueous sodium chloride solution.

Figure 1:
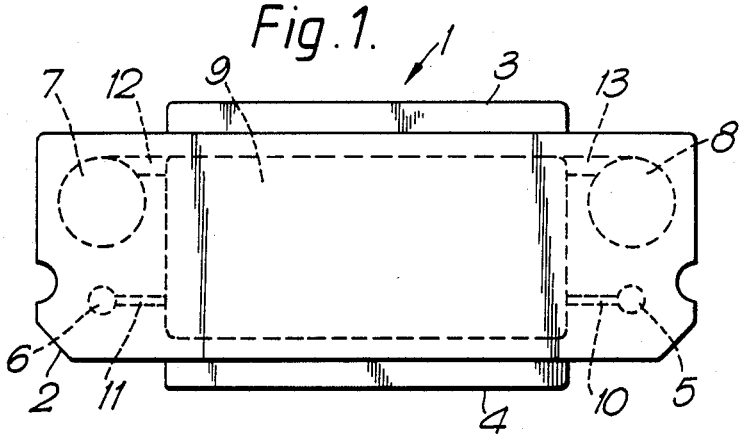
FIG. 1 shows an end view in elevation of an electrolytic cell of the invention.

Referring to FIG. 1 the electrolytic cell is of the filter press type which comprises a plurality of plate-like anodes, cathodes, and gaskets positioned between each anode and adjacent cathode, a cation-exchange membrane also being positioned between each anode and adjacent cathode. It is unnecessary to show in detail the construction of the electrolytic cell. Electrolytic cells of this basic type are described, for example, in our British Pat. No. 1595183 and in our European Pat. No. 45148. The embodiment of FIG. 1 shows an end view of the electrolytic cell 1, the cell comprising an end plate 2. Also shown in FIG. 1 are the extensions 3 and 4 of the anodes and cathodes respectively to which appropriate electrical connections are made.

Each of the anodes, cathodes, and gaskets, but not the end plate 2, comprises four apertures 5, 6, 7, 8 which in the cell together form headers lengthwise of the cell through which, respectively, there are charged to the cell aqueous sodium chloride solution, and water or dilute aqueous sodium hydroxide solution, and through which there are removed from the cell chlorine and depleted aqueous sodium chloride solution, and hydrogen and aqueous sodium hydroxide solution. The solutions are charged to, or removed from, the anode and cathode compartments 9, as the case may be, via channels 10, 11, 12, 13 respectively in the walls of the gaskets.

Figure 2:
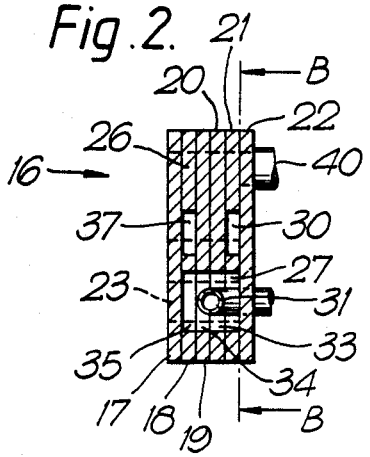
FIG. 2 shows a unit in which liquor recirculation may be effected which is made up of a plurality of shaped sheets, the view of FIG. 2 being in cross-section along the line indicated at A—A of FIG. 3.
Figure 3:
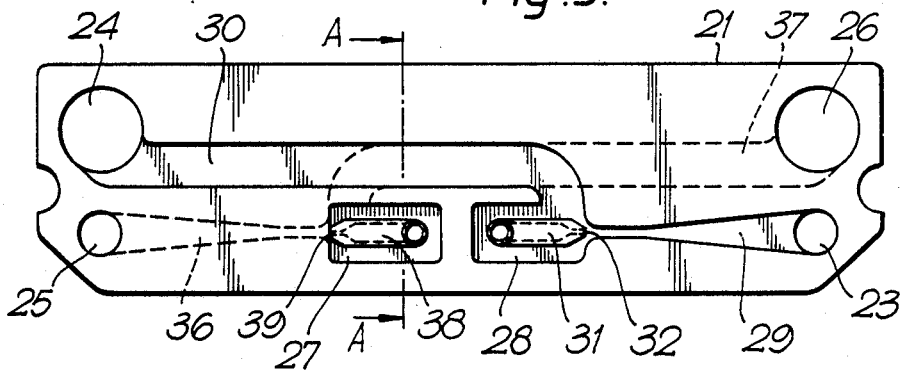
FIG. 3 shows an end view in elevation of one of the sheets from which the unit is made up, the view being along the line B—B of FIG. 2.

Referring to FIGS. 2 and 3 the liquor recirculation unit 16 shown therein comprises six plates 17, 18, 19, 20, 21, 22. Each of the plates 17, 18, 19, 20 and 21 comprises four apertures 23, 24, 25, 26 in a direction transverse to the plane of the plates which together form, respectively, a part of an inlet channel through which aqueous sodium chloride solution is charged to the anode compartments 9 of the electrolytic cell 1, a part of an outlet channel from which chlorine and depleted aqueous sodium chloride solution are discharged from the anode compartments 9 of the electrolytic cell 1, a part of an inlet channel through which water or dilute aqueous sodium hydroxide solution is charged to the cathode compartments 9 of the electrolytic cell 1, and a part of an outlet channel through which hydrogen and aqueous sodium hydroxide solution are discharged from the cathode compartments 9 of the electrolytic cell 1.

Plate 21 comprises a cavity 27 and a cavity 28 and a channel 29 which leads to aperture 23 and which forms a part of the inlet channel through which aqueous sodium chloride solution is charged to the anode compartments 9 of the electrolytic cell 1. Plate 21 also comprises a channel 30 which forms a part of the outlet channel through which depleted aqeuous sodium chloride solution is discharged from the anode compartments 9 of the electrolytic cell 1. Channel 30 leads to cavity 28. An ejector 31 having a throat 32 is positioned in cavity 28.

Plates 20 and 19 comprise cavities 33 and 34 respectively corresponding in position to cavity 27 in plate 21 and two further cavities which are not shown and which correspond in position to cavity 28 in plate 21.

Plate 18 comprises a cavity 35 corresponding in position to cavity 27 in plate 21 and a cavity not shown corresponding in position to cavity 28 in plate 21, and a channel 36 which leads to aperture 25 and which forms a part of the inlet channel through which water or dilute aqueous sodium hydroxide solution is charged to the cathode compartments 9 of the electrolytic cell 1. Plate 18 also comprises a channel 37 which forms a part of the outlet channel through which hydrogen and concentrated aqueous sodium hydroxide solution are discharged from the cathode compartments 9 of the electrolytic cell 1. Channel 37 leads to cavity 27. An ejector 38 having a throat 39 is positioned in cavity 27.

Plate 22 comprises a pipe 40 leading to aperture 26 and a pipe not shown leading to aperture 24 through which, respectively, hydrogen and a part of the aqueous sodium hydroxide solution, and chlorine and a part of the depleted aqueous sodium chloride solution may be removed from the unit 16 and thus from the cell 1.

The channels formed of apertures 23, 25, 24, 26 are connected, respectively, to the headers of the electrolytic cell 1, as shown in FIG. 1, formed of apertures 5, 7, 6 and 8. The sheets 17, 18, 19, 20, 21, 22 of the unit are bonded to each other and to the end plate 2 of the cell 1, or attached by means of tie rods.

In operation concentrated aqueous sodium chloride solution is charged to the anode compartments 9 of the electrolytic cell 1 through ejector 31 and along channel 29 and the channel formed of apertures 23. Chlorine and depleted aqueous sodium chloride solution are discharged from the anode compartments 9 of the electrolytic cell through the channel formed of apertures 24. Chlorine and a part of the depleted aqueous sodium chloride solution are removed from the cell via a pipe (not shown) leading to aperture 24 and the remainder of the depleted solution is passed through channel 30 to cavity 28. The solution issuing from the throat 32 of ejector 31 causes the depleted solution to be passed along channel 29 with the concentrated solution and to be recirculated to the anode compartments 9 of the electrolytic cell 1.

Water or dilute aqueous sodium hydroxide solution is charged to the cathode compartments 9 of the electrolytic cell 1 through ejector 38 and along channel 36 and the channel formed of apertures 25. Hydrogen and aqueous sodium hydroxide solution are discharged from the cathode compartments 9 of the electrolytic cell through the channel formed of apertures 26. Hydrogen and a part of the aqueous sodium hydroxide solution are removed from the cell via pipe 40 leading to aperture 26 and the remainder of the solution is passed through channel 37 to cavity 27.

The solution issuing from the throat 39 of ejector 38 causes the solution to be passed along channel 36 with the water or dilute solution and to be recirculated to the cathode compartments 9 of the electrolytic cell 1.

We claim:

1. An electrolytic cell which comprises at least one anode and at least one cathode, an inlet through which liquor may be charged to the electrolytic cell and an outlet through which liquor may be removed from the electrolytic cell, and means for recirculating liquor to the electrolytic cell, in which said recirculating means comprises a unit formed of a plurality of stacked shaped sheets which together form at least one channel inside of said unit, said channel connecting the inlet and outlet of the electrolytic cell.

2. An electrolytic cell as claimed in claim 1 which comprises at least one anode and at least one cathode and a separator positioned between each anode and adjacent cathode thereby dividing the cell into separate anode and cathode compartments.

3. An electrolytic cell as claimed in claim 2 which comprises an inlet header through which liquor may be charged to the anode compartments of the electrolytic cell, and an outlet header through which liquor may be removed from the anode compartments of the electrolytic cell, in which the recirculating means comprises a unit formed of a plurality of shaped sheets which together form at least one channel inside of the unit, the channel connecting the inlet and outlet headers of the anode compartments of the electrolytic cell.

4. An electrolytic cell as claimed in claim 2 or claim 3 which comprises an inlet header through which liquor may be charged to the cathode compartments of the electrolytic cell, and an outlet header through which liquor may be removed from the cathode compartments of the electrolytic cell, in which the recirculating means comprises a unit formed of a plurality of shaped sheets which together form at least one channel inside of the unit, the channel connecting the inlet and outlet headers of the cathode compartments of the electrolytic cell.

5. An electrolytic cell as claimed in claim 2 in which the unit is formed of a plurality of shaped sheets which together form at least two channels inside of the unit one of which channels connects the inlet and outlet headers of the anode compartments of the electrolytic cell and another of which channels connects the inlet and outlet headers of the cathode compartments of the electrolytic cell.

6. An electrolytic cell as claimed in any one of claims 1 to 5 in which the electrolytic cell is of the filter press type which comprises a plurality of substantially planar anodes and cathodes and a plurality of gaskets of an electrically non-conducting material.

7. An electrolytic cell as claimed in claim 6 in which the gaskets are positioned between adjacent anodes and cathodes.

8. An electrolytic cell as claimed in claim 6 in which the anodes and cathodes are positioned within frame-like gaskets.

9. An electrolytic cell as claimed in claim 7 which comprises inlet and outlet headers which are formed by apertures in the gaskets and in the anodes and cathodes.

10. An electrolytic cell as claimed in claim 8 which comprises inlet and outlet headers which are formed by apertures in the gaskets.

11. An electrolytic cell as claimed in claim 1 in which the sheets which make up the unit in the electrolytic cell are so shaped as to provide an inlet channel through which liquor may be charged to the unit and thence to the electrolytic cell.

12. An electrolytic cell as claimed in claim 11 in which the unit comprises an inlet channel through which liquor may be charged to the anode compartments of the electrolytic cell.

13. An electrolytic cell as claimed in claims 11 or 12 in which the unit comprises an inlet channel through which liquor may be charged to the cathode compartments of the electrolytic cell.

14. An electrolytic cell as claimed in claim 1 in which the sheets which make up the unit in the electrolytic cell are so shaped as to provide an outlet channel through which liquor may be removed from the unit and thence from the electrolytic cell.

15. An electrolytic cell as claimed in claim 14 in which the unit comprises an outlet channel through which liquor may be removed from the anode compartments of the electrolytic cell.

16. An electrolytic cell as claimed in claims 14 in which the unit comprises an outlet channel through which liquor may be removed from the cathode compartments of the electrolytic cell.

17. An electrolytic cell as claimed in claim 1 in which the sheets of the units are substantially planar.

18. A electrolytic cell as claimed in claim 1 in which in the unit a sheet comprises a groove in a face of a sheet which, when placed adjacent to a plane sheet, forms a channel in the plane of the sheets.

19. An electrolytic cell as claimed in claim 1 in which in the unit two sheets each comprise a groove in the face of each sheet which when positioned adjacent to each other form a channel in the plane of the sheets in the unit.

20. An electrolytic cell as claimed in claim 1 in which in the unit a sheet comprises a slot which forms a channel in the plane of the sheets when plane sheets are positioned on either side of the slotted sheet.

21. An electrolytic cell as claimed in claim 1 in which in the unit the sheets comprise an aperture or apertures which cooperate with each other to form a channel or channels in the unit in a direction generally transverse to the plane of the sheets.

22. An electrolytic cell as claimed in claim 21 in which in the unit the sheets comprise apertures therein which cooperate to form a channel or channels in a first direction in the unit transverse to the plane of the sheets, and at least some of the sheets comprise slots or grooves which in the unit form a channel or channels in a second direction in the plane of the sheets and which is or are generally transverse to the first direction, the channel or channels in the first direction being operatively connected to the channel or channels in the second direction.

23. An electrolytic cell as claimed in claim 21 in which the channel or channels in the unit in a direction generally transverse to the plane of the sheets are connected to the inlet and outlet to the electrolytic cell.

24. An electrolytic cell as claimed in claim 23 in which in the unit the sheets have four apertures therein which lead to the inlet headers to the anode and cathode compartments of the electrolytic cell and which lead from the outlet headers from the anode and cathode compartments of the electrolytic cell.

25. A process for the electrolysis of an aqueous solution of an alkaline metal chloride in which the electrolysis is effected in an electrolytic cell which comprises at least one anode and at least one cathode, an inlet through which liquor may be charged to the electrolytic cell and an outlet through which liquor may be removed from the electrolytic cell, and means for recirculating liquor to the electrolytic cell, in which said recirculating means comprises a unit formed of a plurality of stacked shaped sheets which together form at least one channel inside of said unit, said channel connecting the inlet and outlet of the electrolytic cell.

* * * * *